US008201691B1

(12) United States Patent
Chowdhury

(10) Patent No.: US 8,201,691 B1
(45) Date of Patent: Jun. 19, 2012

(54) PILL INTAKE REMINDER AND CONTAINER CAP DEVICE AND METHOD OF USE THEREOF

(76) Inventor: Zac Chowdhury, Venice, CA (US)

( * ) Notice: Subject to any disclaimer, the term of this patent is extended or adjusted under 35 U.S.C. 154(b) by 397 days.

(21) Appl. No.: 12/404,255

(22) Filed: Mar. 13, 2009

(51) Int. Cl.
*B65D 83/04* (2006.01)

(52) U.S. Cl. ..... 206/534; 206/459.1; 220/212; 215/228; 116/306

(58) Field of Classification Search ..... 206/459.1, 206/459.5, 534, 1.5; 215/230, 228; 220/212, 220/796, 522, 521, 254.1; 116/306, 308, 116/316, 307, 279; 40/307, 310–312; 221/2, 221/8; 235/379–381, 123
See application file for complete search history.

(56) References Cited

U.S. PATENT DOCUMENTS 4,666,051 A * 5/1987 Trick ..... 215/230
5,119,963 A * 6/1992 Heilman ..... 215/230
5,520,307 A * 5/1996 Miller et al. ..... 221/2
5,967,350 A * 10/1999 Jones ..... 215/222
5,979,647 A * 11/1999 Han ..... 206/222
6,003,467 A * 12/1999 Shelton-Ferrell et al. .... 116/309
6,545,592 B2 * 4/2003 Weiner ..... 368/10
6,938,768 B2 * 9/2005 Ferretti et al. ..... 206/459.1
2006/0249410 A1 * 11/2006 Vandenbroek et al. ..... 206/340
* cited by examiner

*Primary Examiner* — J. Gregory Pickett
*Assistant Examiner* — Andrew Perreault
(74) *Attorney, Agent, or Firm* — Michael A. Marcelli

(57) ABSTRACT

An easy pill intake reminder that screws on the top of a container for articles such as medications and or vitamins in the form of pills, caplets, capsules, and or tablets and which serves as a cap there on, is surmounted by a cylinder housing a number of wedge shaped buttons marking a periodic time frame such as the days of the week all arrayed around a central circular button. Each wedge shape button can be lowered individually to mark a respective period of time such as a day, and stays lowered until the central button is pushed down. The lowering of the central button resets the surrounding wedge buttons to their upper position and thereby enabling the users to repeat the process.

14 Claims, 10 Drawing Sheets

PILL INTAKE REMINDER AND CONTAINER CAP DEVICE AND METHOD OF USE THEREOF

RELATED APPLICATIONS

Application Ser. No. 29/327,763 which is hereby incorporated by reference as though set forth fully herein.

STATEMENT REGARDING FEDERALLY FUNDED RESEARCH

Not Applicable.

BACKGROUND AND BRIEF DESCRIPTION OF THE INVENTION

This invention relates generally to the field of pill, caplet, capsule, and tablet intake reminder devices. Moreover, it pertains specifically to a pill intake reminder and container cap device that allows a person to maintain a count of their pill intake while at the same time acting as a pill container cap.

People often need an easy reminder of their pill intake. Today a large number of the population has a daily regiment of medications and or vitamins in the form of pills, caplets, capsules, and or tablets. Keeping count of their intake can be a confusing task. Various pill intake reminder are known among the prior art. One type of reminder is comprised of a dial system consisting of very small print. This small print renders the device difficult to read. Such a device cannot be used without careful examination and can lead to mistakes. Another type of reminder uses a digital readout. However, the cost of such a device prohibits its wide scale use. Most pill intake reminders are comprised of many small and delicate pieces, they can be clunky and difficult to use and even more difficult to manufacture due to their complexity. They can also break easily if the device is dropped.

The present invention is intended to cure these deficiencies. First, the present invention provides a pill intake reminder & container cap device that serves as both an article intake reminder as well as a container cap. The pill intake reminder aspect of this invention provides the user with an easy and reliable means to check his or her daily intake of medications and/or vitamins in the form of pills, caplets, capsules, and or tablets. Furthermore, the cap portion of the device, being a simple threaded cap, can be equipped with any number of established child proofing devices should the intended application require child proofing.

Second, the present invention is easy to read. The tops of the buttons may be embossed, imprinted, colored, or otherwise marked with the user's intake regiment. The tops of the buttons may also be labeled in Braille for use by visually impaired persons. Additionally, the tops of the buttons themselves may be shaped to permit the user to tactilely feel the number of buttons that have been depressed and monitor usage thusly.

Finally, the present invention is a simple, robust design. The invention is comprised of three basic types of parts: the reminder buttons, a housing/cap and a reset button. These parts may be manufactured by conventional machining processes; however, they may also be made utilizing inexpensive, injection molding processes. Thus, unlike more expensive intake reminders, the present invention may be considered a disposable item.

BRIEF DESCRIPTION OF THE SEVERAL VIEWS OF THE DRAWINGS

FIG. 11 also shows a view of a button at the 9:00 position. This depiction also shows the following features of the button (3): two outer radius planes (3A), outer bottom tab (3C); an inner radius plane (3D); an inner radius plane retainer latch (3E); and, a button guide retainer cylinder (3F).

Figure Number Identification:

Figure 1:
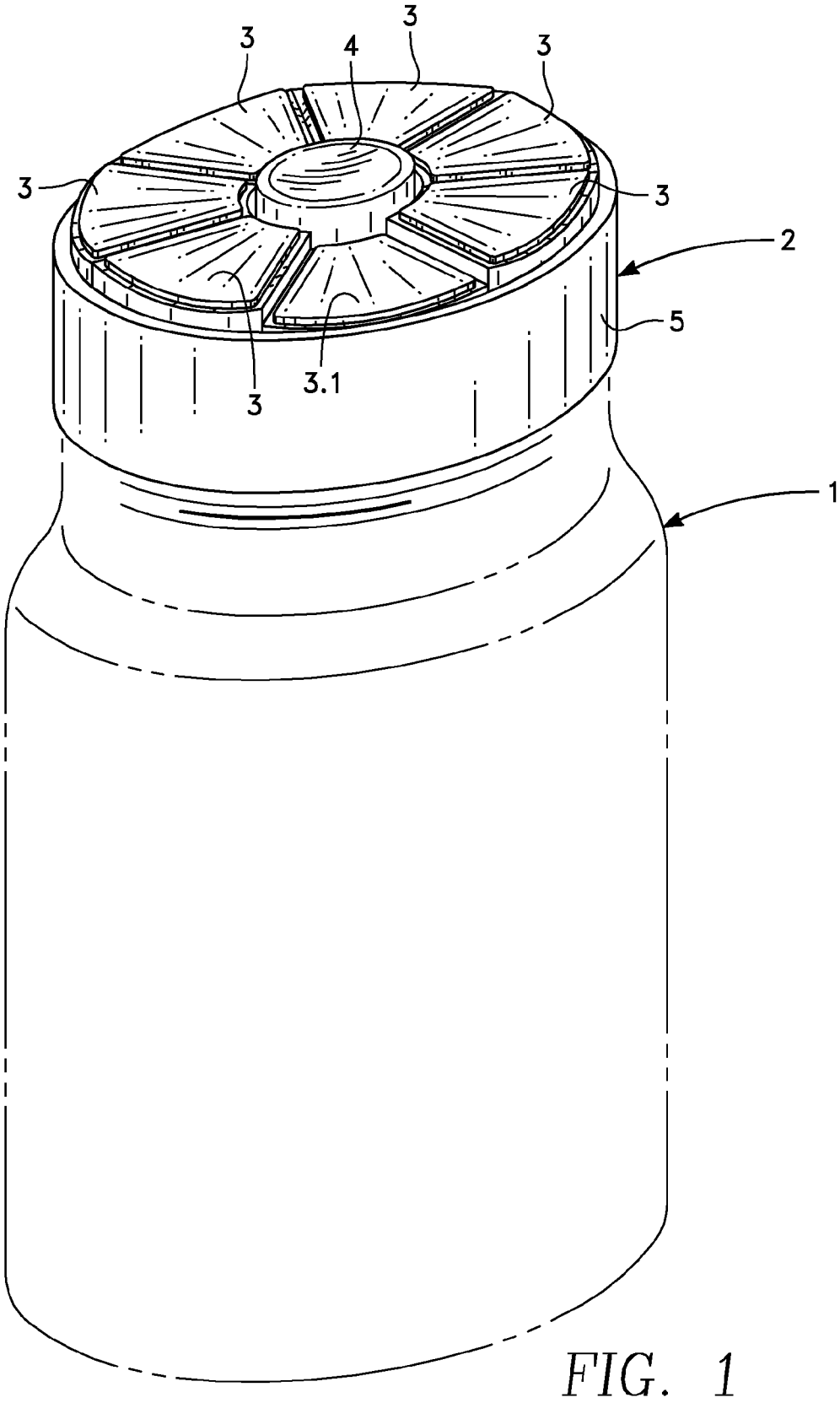
FIG. 1: A prospective view of the invention (2) attached to a pill bottle (1), seven buttons (3) with one button depressed (3.1) and the center reset button (4).

| | |
|---|---|
| 1. | Pill Bottle |
| 2. | Complete Invention |
| 3. | Button |

-continued

| Figure Number Identification: | | |
|---|---|---|
| | 3A | Outer radius plane |
| | 3B | Button upper surface |
| | 3C | Button outer bottom tab |
| | 3D | Inner radius plane |
| | 3E | Inner radius plane retainer latch |
| | 3F | Button guide containment cylinder |
| 4. | Center reset button | |
| | 4A | Center reset button post |
| | 4B | Retaining ring |
| | 4C | Curved lower surface |
| 5. | Main Body | |
| | 5A | Main body threaded lower section |
| | 5B | Main body upper section |
| | 5C | Main body containment lip |
| | 5D | Outer radius plane ramp |
| 6. | Wedge Shaped Button Guides | |
| 7. | Central locking lip | |
| 8. | Reset Button Guide | |
| 9. | Reset Button Post Container | |
| 10. | Reset Spring | |
| 11. | Cylindrical Button Guides | |

DETAILED DESCRIPTION OF THE INVENTION

As set forth in FIGS. 1 through 24, the invention (2) is generally comprised of four categories of parts: one or more buttons (3), a center reset button (4); a main body (5); and, an optional reset spring (10). While these parts could be fabricated using conventional machining methods, with the exception of the optional reset spring (10), each of the aforementioned parts could be fabricated from plastics via injection molding. The ease of manufacturing these parts, and the overall small number of different types of parts needed, are significant advantages over those similar devices existing in the prior art. Furthermore, these parts snap together and are held in place by mechanical locks that are built into the design of the various pieces, rendering fasteners unnecessary.

Figure 10A:
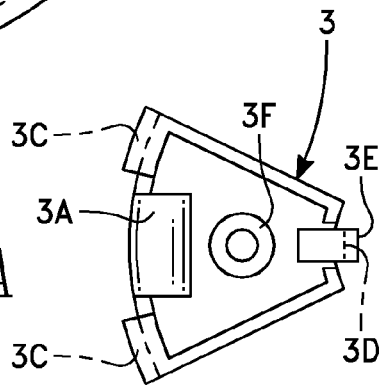
FIG. 10A is a bottom expanded view of one of the buttons for the embodiment comprising cylindrical button guides. Depicted are: the outer radius plane (3A); outer bottom tab (3C); inner radius plane (3D); inner radius plane retainer latch (3E); and button guide containment cylinder (3F).
Figure 10:
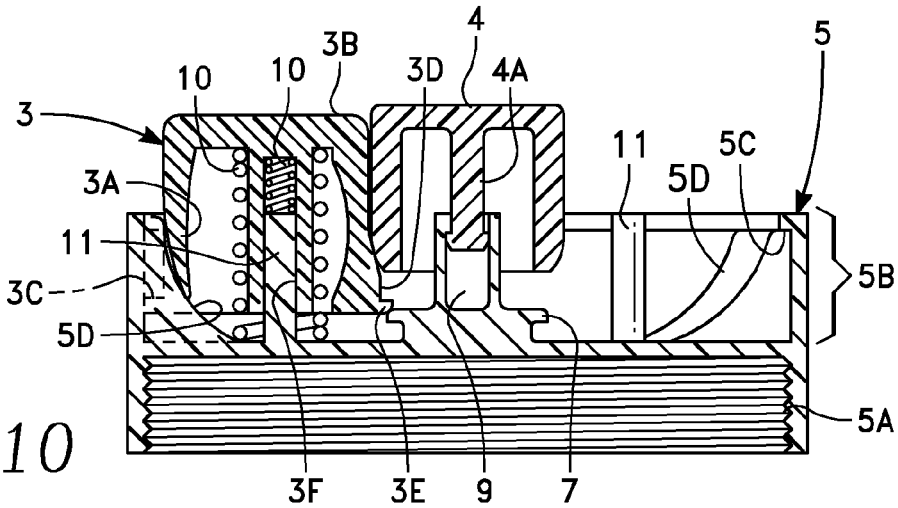
FIG. 10 is a cross-sectional view of taken along the plane marked as 10-10 in FIG. 9. The features labeled in this view include the: button (3); outer radius plane (3A); button upper surface (3B); button outer bottom tab (3C); inner radius plane (3D); inner radius plane retainer latch (3E); button guide containment cylinder (3F); center reset button (4); center reset button post (4A); main body threaded lower section (5A); main body upper section (5B); main body containment lip (5C); outer radius plane ramp (5D); central locking lip (7); reset button containment cylinder (9); and, cylindrical button guides (11). This view also shows the potential placement of coil springs (10) inside the button guide containment cylinder (3F) and exterior to the button guide containment cylinder (3F), which coil springs would either replace or assist the "outer springs" found in this embodiment.

The reminder buttons (3) are comprised of: an outer radius plane (3A); an upper surface (3B); an outer bottom tab (3C); an inner radius plane (3D); and, an inner radius plane retainer latch (3E). An optional button guide containment cylinder (3F) is required for embodiments utilizing cylindrical button guides (11). See, e.g., FIGS. 10 and 10A. The preferred material for the reminder buttons is a pliable, yet memory resilient, plastic.

Figure 2A:
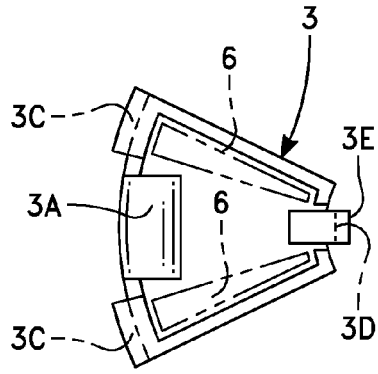
FIG. 2A: A bottom view of a single button (3) showing: the outer radius plane (3A); outer button tabs (3C); the inner radius plane (3D); and the inner radius plane retainer latch (3E). The dashed wedges represent the spatial location of the guides (6) within the button's hollow lower cavity.
Figure 2:
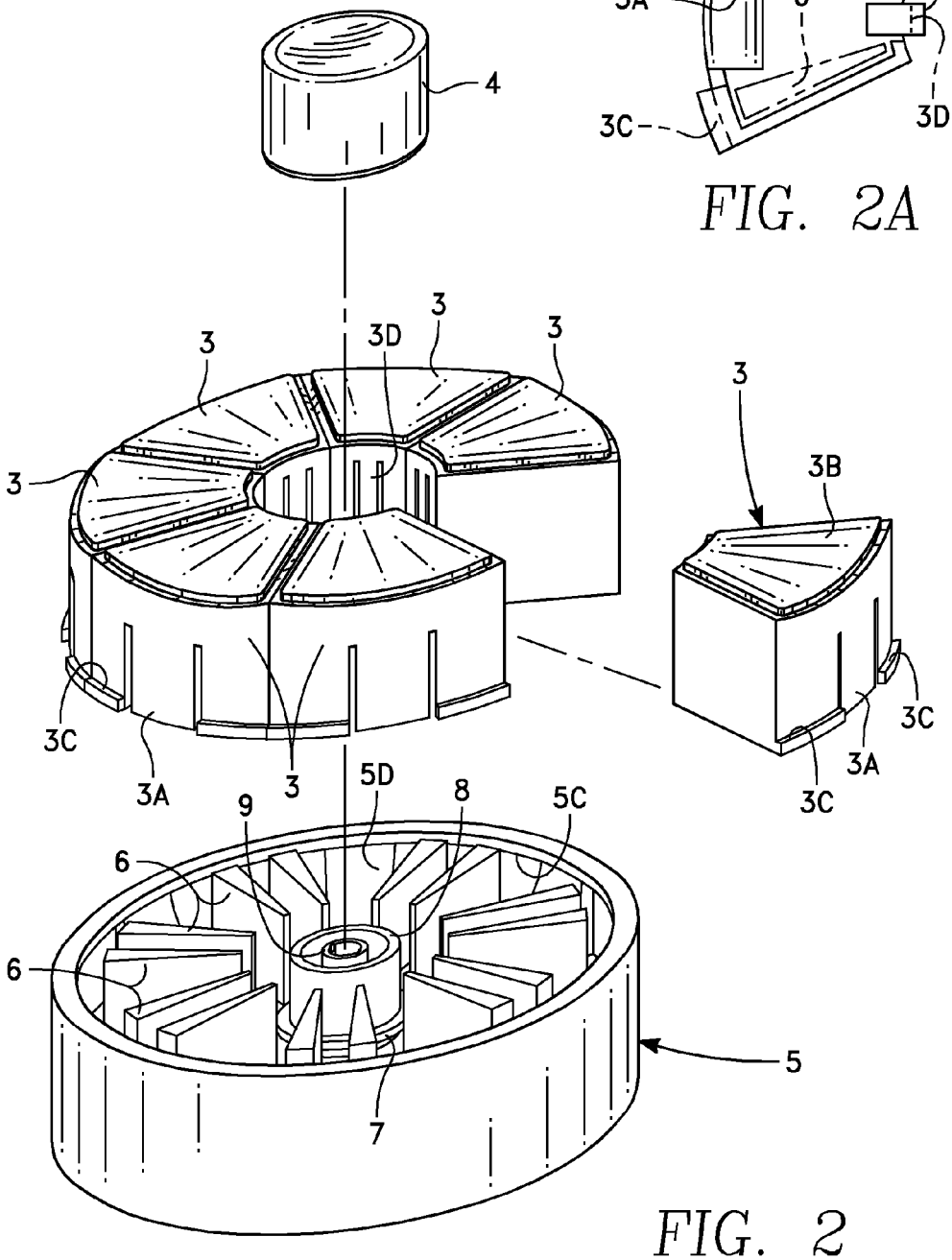
FIG. 2: A prospective view of the invention showing: seven radial buttons (3); said radial buttons (3) each further comprising an outer radius plane (3A); an upper surface (3B) and the inner radius plane (3D); the center reset button (4); the main body (5); main body containment lip (5C); outer radius plane ramp (5D); seven pairs of wedge shaped guides (6); central locking lip (7); reset button guide (8); and the reset button post container (9).
Figure 3:
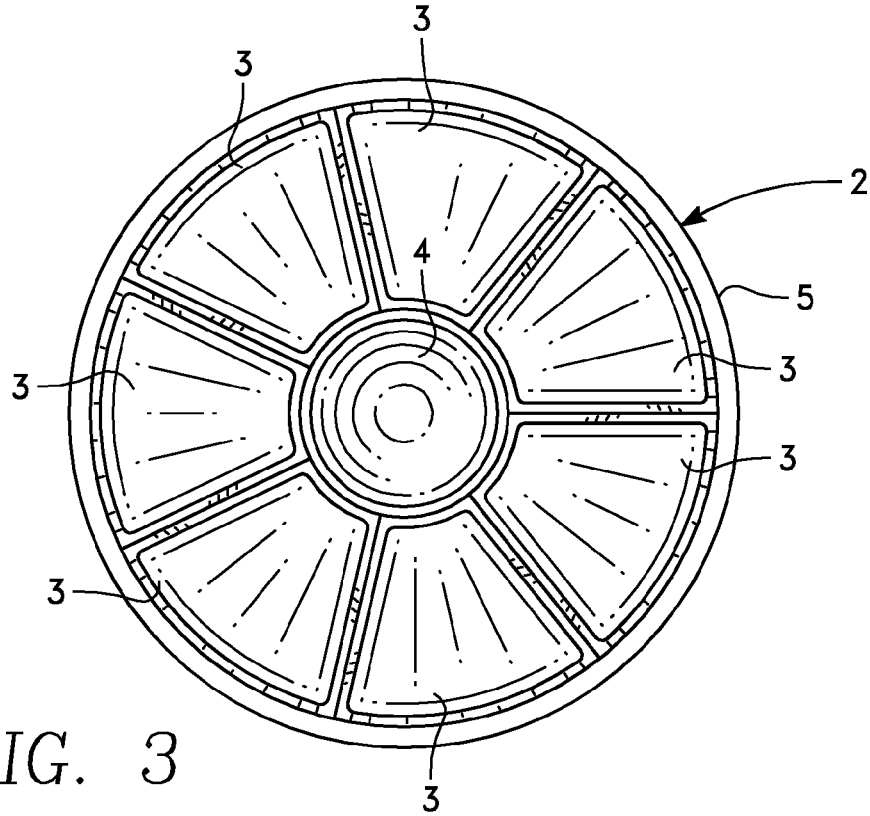
FIG. 3: A top view of the invention (2) showing seven identical equidistantly spaced buttons (3); a center reset button (4); and the main body (5).

Each of the reminder buttons has a front, rear, top, bottom and sides. The rear section of the button (3) is comprised of a center section and two sides. The center section is the outer radius plane (3A). The two side sections contain the bottom outer tabs (3C). See, e.g., FIGS. 2 and 2A. The outer radius plane (3A) acts as a spring and may be referred to herein as the "outer spring."

When a downward force is applied the top surface of the button (3B), this "outer spring" (3A) interacts with the outer radius plane ramp (5D); that is, it compresses and stores energy. See, e.g., FIGS. 6 and 7. Thus, the preferred plastic for this "outer spring" must be both pliable and memory resilient. The "outer spring" must be pliable so that it does not break while being compressed. The "outer spring" must also be resilient so that it tends to retain its shape while compressed and thus wants to return to its pre-compressed shape when the downward force is removed. See, e.g., FIG. 8.

While using a plastic "outer spring" (3A) and ramp (5D) is the most cost effective and easiest to method to manufacture this invention, an alternative embodiment exists that utilizes coil springs (10) to assist or replace the "outer spring"/ramp combination (3A)/(5D). In this alternative embodiment, coil springs (10) are either wrapped around the outside of the button guide containment cylinder (3F), or alternatively, placed within the button guide containment cylinder (3F) on top of the cylindrical button guide (11). See, FIG. 10.

The upper surface of the button, (3A) may also contain a usage indicator to permit the user to identify when his or her last pill was taken. For example, the top surface of the buttons could be imprinted, embossed, painted, or otherwise marked with commonly recognized usage indicators, such as AM, PM, the days of the week, or their commonly held abbreviations, foreign languages, symbols, letters, colors or even numbers (for example, a prescription that required the user to take a pill four times per day could simply be marked with the numbers one through four). Furthermore, a tactile sign, such as the Braille equivalents of said usage indicators could also be used separately or in conjunction with visual indicators.)

The front of the button (3), is the surface of the button closest to the center reset button (4) when the device is fully assembled. See, e.g., FIG. 2. The center of the front of the button comprises a second "inner spring," identified as the inner radius plane (3D). See, e.g., FIGS. 2, 2A and 8. The surface of the inner radius plane (3D) most proximate to the center reset button (4), the "inner surface," curves outward, that is, towards the center reset button. This curvature begins at the approximate midpoint of the inner radius plane and continues towards the button's bottom, thereby creating a ramp. See, e.g., (3D) FIG. 10A. The portion of the inner radius plane (3D) farthest from the upper surface of the button (3B), i.e., the bottom of the inner radius plane, terminates in a latch referred to as the inner radius plane retainer latch (3E). See, e.g., FIG. 2. When the button (3) is fully depressed, the inner radius plane latch (3E) snaps over the central locking lip (7) causing the button to remain in the down position. See, FIG. 7.

The main body of the invention (5) is comprised of seven parts: the threaded lower section (5A); the upper section (5B); the containment lip (5C); outer radius plane ramps (5D); guides (6) or (11); the reset button containment cylinder (9); and, the central locking lip (7). The lower section of the main body (5A) is threaded and may be equipped with one of any number of existing child proofing devices, such as those that require the user to press down forcefully on the top of the cap to turn and remove it. The threaded lower section (5A) allows the invention to act as the lid or cap of the pill bottle.

The upper section of the main body (5B) comprises the intake reminder portion of the invention. The main body upper section comprises: the containment lip (5C); the outer radius plane ramps (5D); button guides (6) and/or (11); the central locking lip (7); the reset button guide (8) and the reset button post container (9). See, e.g., FIGS. 2, 4, 9, and 11. As with the buttons, the entire main body (5) is comprised of plastic.

Assembly of the device is achieved and maintained without the use of fasteners. The main body upper section (5B) houses the reminder buttons (3) and the center reset button (4) utilizing a snug, snap together, fit.

The buttons (3) are installed by first aligning them over the guides (6) or (11) such that the outer radius plane (3A) is centered over the outer radius plane ramp (5D). See FIG. 4. Next, sufficient force is applied to the top surface of the button (3B) to cause the button's outer bottom tabs (3C) to snap over the main body's containment lip (5C). Once the buttons are snapped into place, the rear of the button is effectively locked into the main body. See, e.g., FIG. 10.

Once all of the reminder buttons (3) are installed in the main body (5), the center reset button (4) is aligned so that its post (4A) is concentric with the reset button post container (9). Next, the center reset button is snapped into place. (Note: Depending upon the application and the ability of the "outer springs" to raise both the buttons (3) and the center reset button (4) when the device is reset, it may be necessary to install a reset spring (10) between the reset button post container (9) and the reset button guide prior to snapping the center reset button in place). See, FIG. 5. Once in place, the retaining ring (4B) on the center post (4A) prevents the center reset button from coming out of the reset button post container (9). Furthermore, the presence of the center reset button (4), in conjunction with the curved front surfaces of the buttons (3), (i.e., the ramps of the inner radius planes (3D)), lock the fronts of the reminder buttons (3) into the main body upper section (5B) of the invention.

Figure 4:
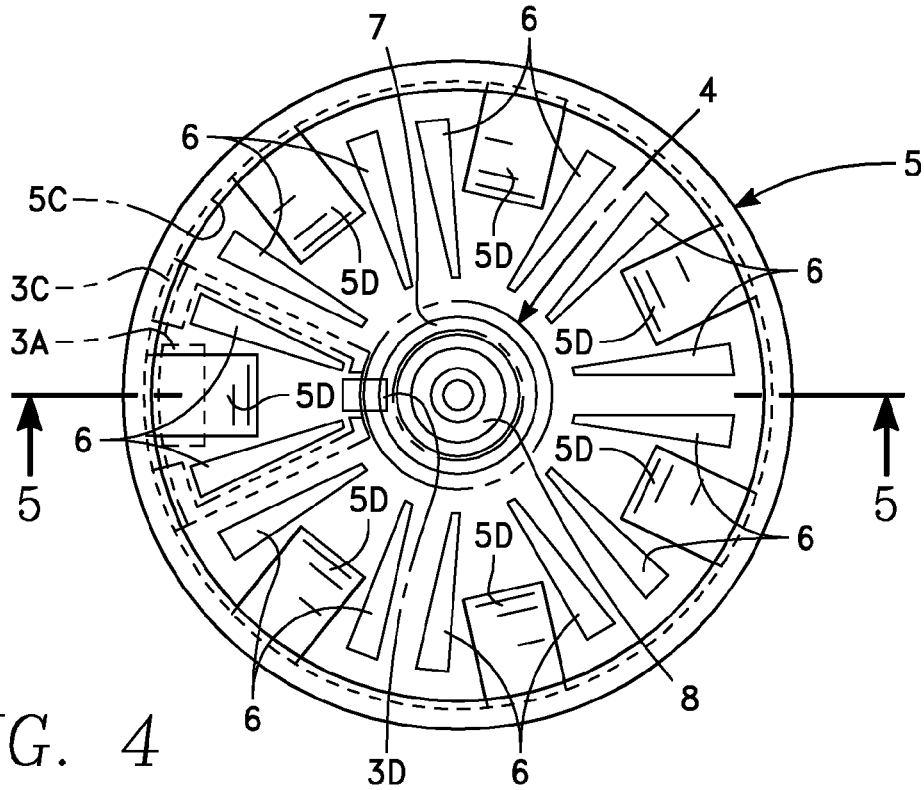
FIG. 4: A top view of the main body (5) depicting: an interior dashed cylinder showing the spatial relationship of the center reset button (4); seven equidistantly spaced outer radius plane ramps (5D) and seven sets of equidistantly spaced wedge shaped button guides (6). The outer dashed circumference indicates how the spatial relationship of the outer button tabs (3C) to the containment lip (5C) within the outer radius of the main body (5). The dashed outline of a button is included at the 9:00 location in the drawing to demonstrate the spatial location of the button, the outer radius plane (3A) and the inner radius plane (3D) to the outer radius plane ramp (5D); wedge shaped guides (6) and central locking lip (7).
Figure 5:
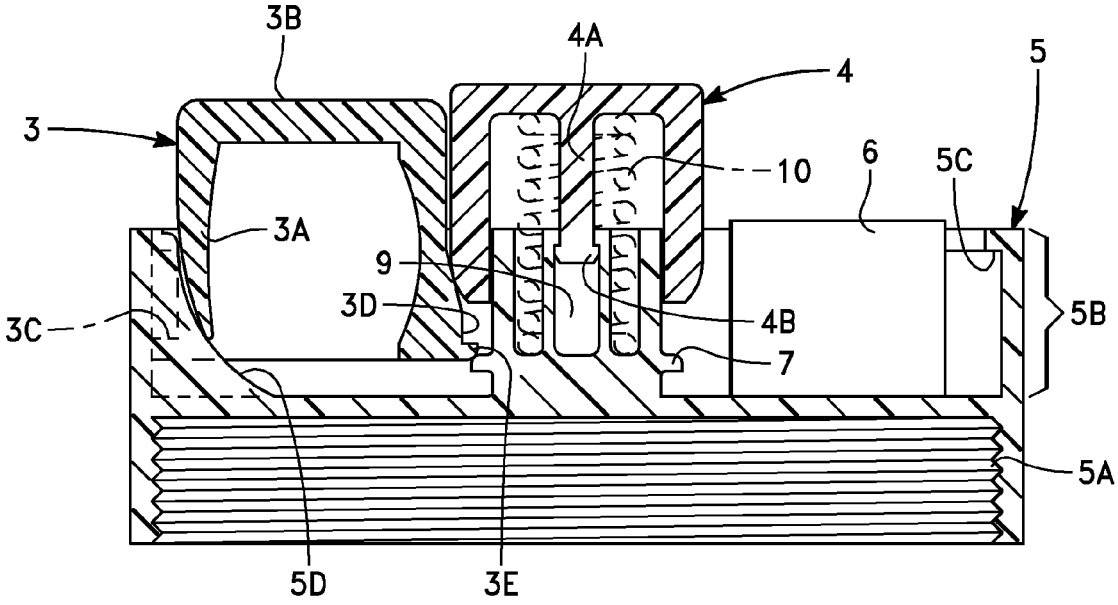
FIG. 5 is a cross-sectional view of taken along the plane marked as 5-5 in FIG. 4 depicting: a fully extended button (3); a fully extended outer radius plane (3A); a cross sectional view of the upper surface of the button (3B); an outer bottom tab in dashed outline (3C); a fully relaxed inner radius plane (3D); the inner radius plane retainer latch (3E); the center reset button (4); the center reset button post (4A); the center reset button post retainer (4B); the main body threaded lower section (5A); the main body upper section (5B); the main body containment lip (5C); the outer radius plane ramp (5D); a wedge shaped guide (6) the central locking lip (7); reset button post container (9); and, an optional reset spring (10).
Figure 6:
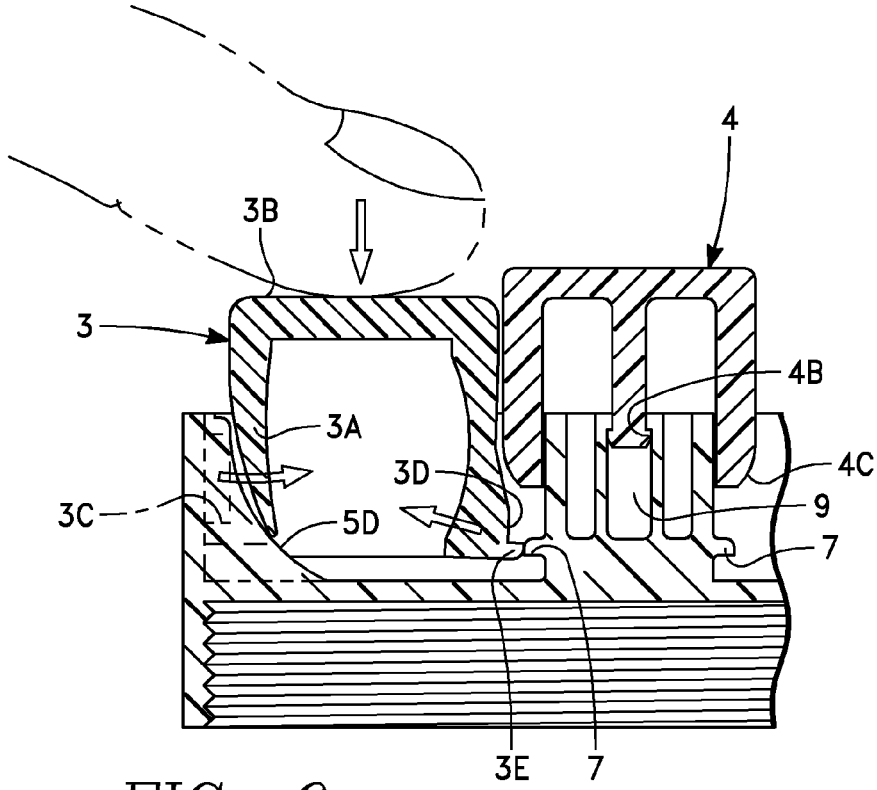
FIG. 6 depicts the actuation of one of the buttons. Finger pressure is applied to the top surface of the button (3B). The force compresses the outer radius plane (3A) causing it to slide along the outer radius plane ramp (5D). The force also causes the lower radius of the inner radius plane retainer latch (3E) to slide over the central locking lip (7), thereby compressing the inner radius plane (3D). The center reset button (4) remains at its fully extended position. Also labeled in this figure are the: button outer bottom tab (3C); center reset button post retaining ring (4B); center reset button curved lower surface (4C); and, reset button post container (9).
Figure 7:
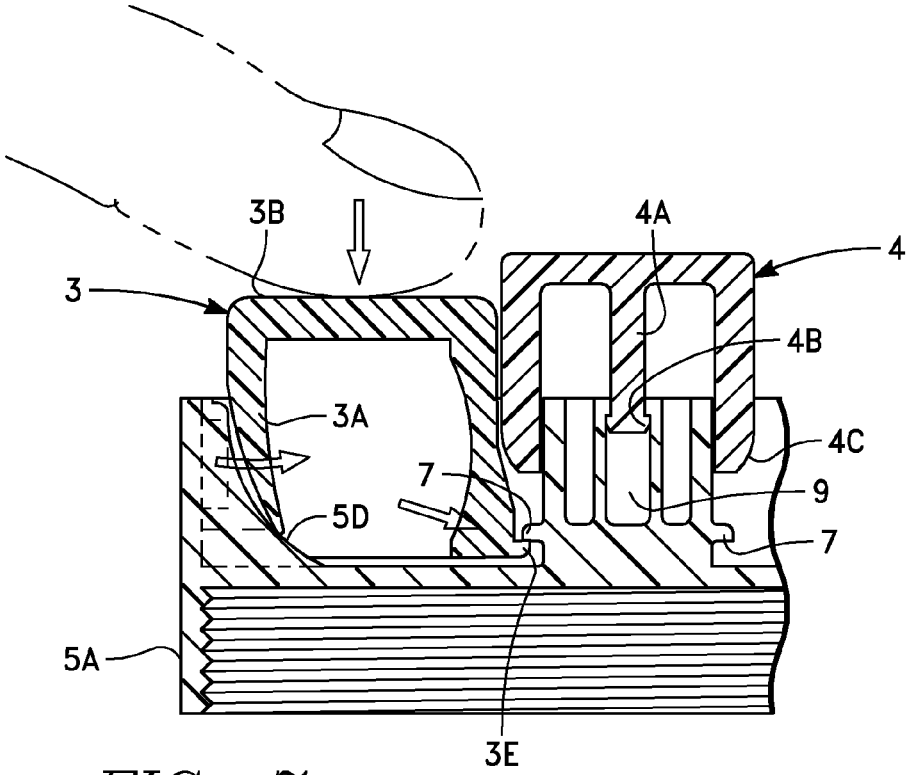
FIG. 7 depicts the fully compressed/actuated button (3). When sufficient pressure is applied to the upper surface of the button (3B), the outer radius (3A) and inner radius planes are compressed to a point where the inner radius plane retainer latch (3E) snaps over the central locking lip (7) and the button (3) is held in its depressed position. Also labeled in this figure are the: center reset button (4); center reset button post (4A); center reset button retainer ring (4B); center reset button curved lower surface (4C); main body threaded lower section (5A); outer radius plane ramp (5D); and, reset button post container (9).
Figure 8:
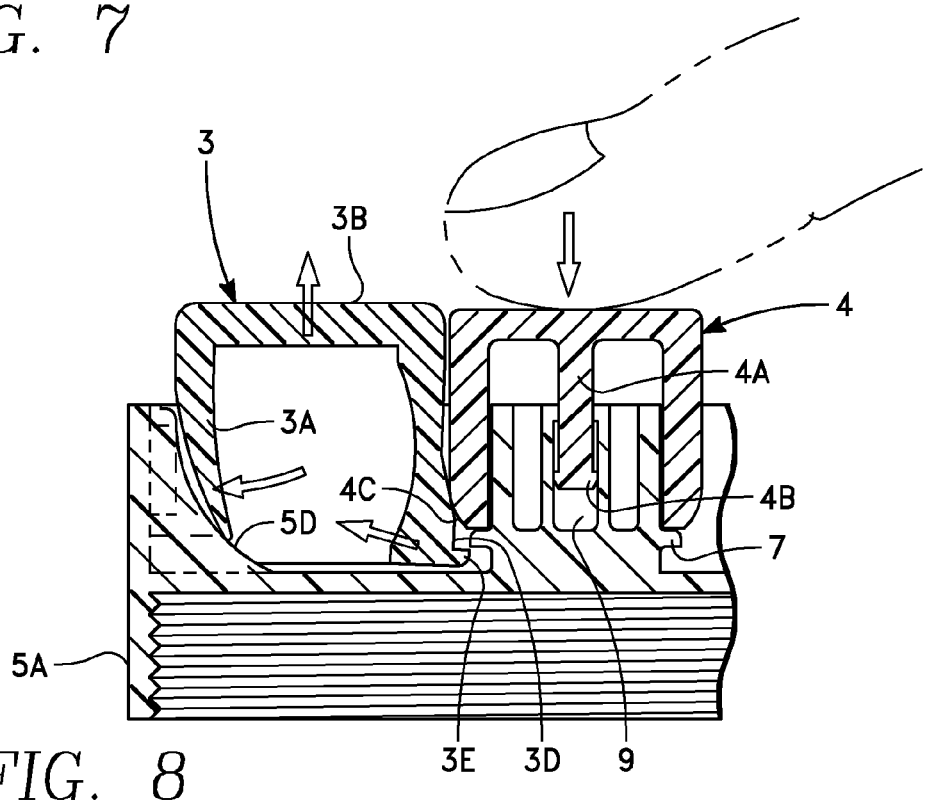
FIG. 8 depicts the method for resetting the depressed buttons (3). The user depresses the center reset button (4) the curved lower surface of the center reset button (4C) contacts the inner radius plane (3D), thereby depressing the inner radius plane and causing the inner radius plane retainer latch (3E) to disengage from the central locking lip (7). As pressure is released from the center reset button (4), the center reset button and button(s) (3) rise in unison. Also labeled in this figure are the: the outer radius (3A); button top surface (3B); inner radius (3D) planes; center reset button post (4A); center reset button retainer ring (4B); and, main body threaded lower section (5A).
Figure 9:
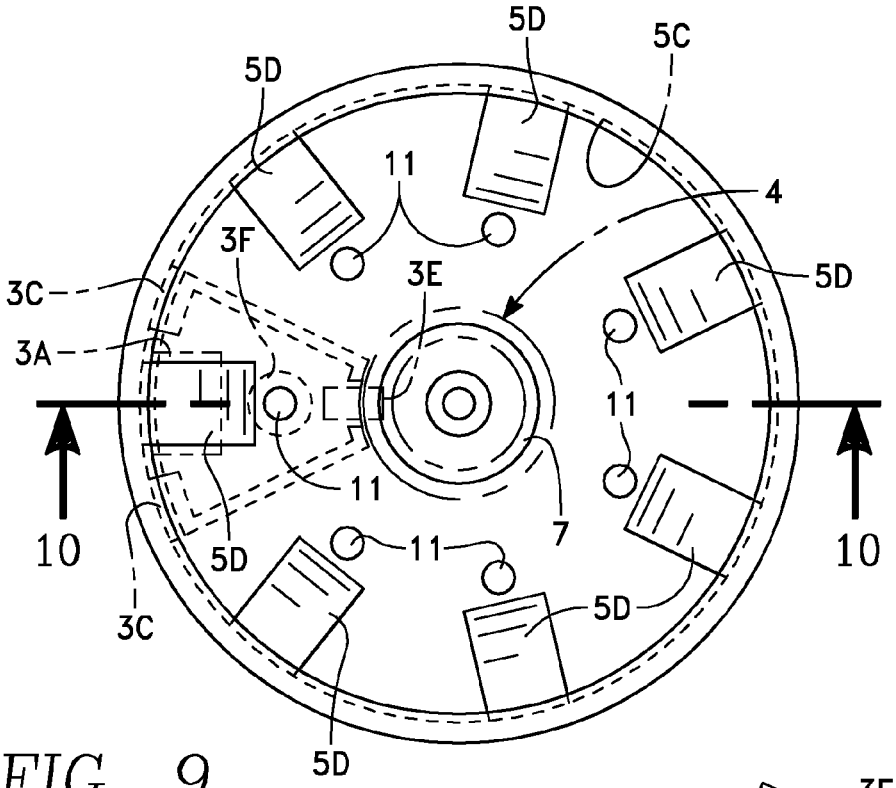
FIG. 9 is a top view depicting an alternative seven button embodiment wherein equidistantly spaced cylindrical button guides (11) are used in place of wedge shaped guides. One should note that a single cylindrical button guide (11) replaces a pair of wedge shaped guides (6) utilized in the embodiment depicted in FIG. 4. This embodiment also lends itself to the elimination of the outer radius planes (3A) on the buttons and outer radius plane ramps (5D) on the upper body main section (5B), i.e., the "outer springs." In place of these "outer springs," a coil spring (10) could be placed either inside the button guide containment cylinder (3F) or exterior to the button guide containment cylinder (3F). See FIG. 10. The dashed lines at 9:00 in the figure show the spatial relationship of one of the buttons to the cylindrical button guides. Also labeled in this figure are the: button outer bottom tabs (3C); inner radius plane retainer latch (3E); center reset button (4); and, the central locking lip (7).
Figure 11:
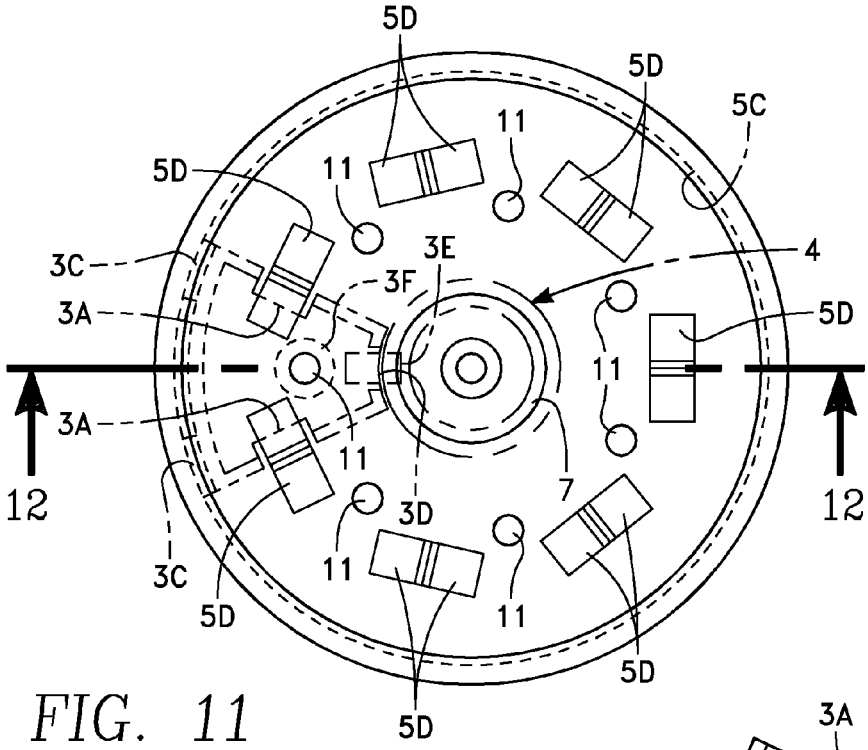
FIG. 11 is a top view of an alternative seven button embodiment wherein the outer radius plane ramps (5D) have been doubled in number and relocated from the outer radius of the device to an inner radius between the outer wall of the housing and the center reset button and equidistantly spaced between the cylindrical button guides (11).
Figure 11A:
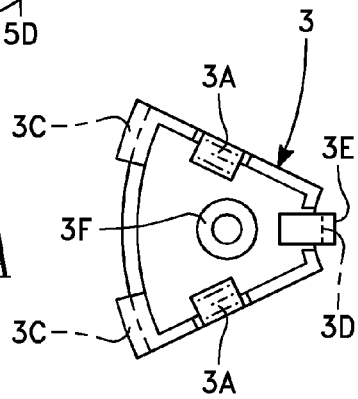
FIG. 11A is an expanded view of one of the buttons (3) of the embodiment depicted in FIG. 11. The numbered features include: dual outer radius planes (3A); outer bottom tab (3C); inner radius plane (3D); inner radius plane retainer latch (3E); and button guide containment cylinder (3F).
Figure 12:
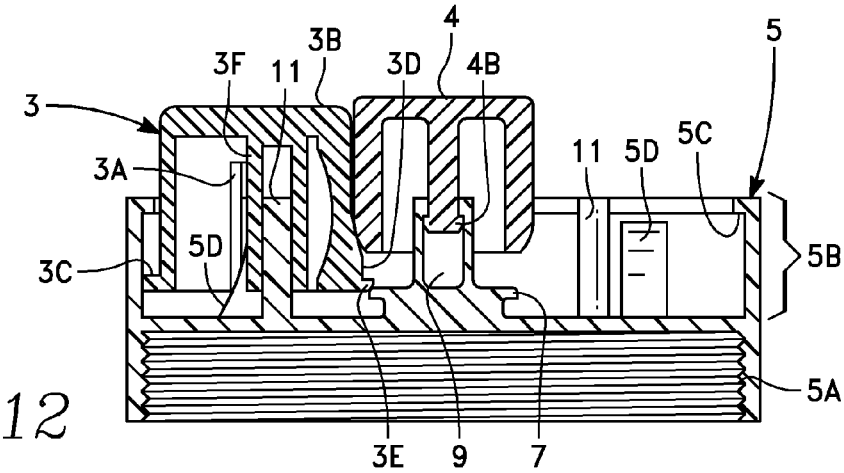
FIG. 12 is a side view of the embodiment wherein the outer radius plane ramps (5D) have been doubled and relocated from the outer radius of the device to an inner radius between the outer wall of the housing (5) and the center reset button. This view shows the upper surface of the button (3B); the outer radius plane (3A), the inner radius plane (3D) the inner radius plane retainer latch (3E); a cross sectional view of the button guide retainer cylinder (3F); the center reset button (4); the center reset button retainer ring (4B); the main body threaded lower section (5A); main body upper section (5B); the main body containment lip (5C); outer radius plane ramps (5D); a cross sectional view of the central locking lip (7); reset button post container (9); and, cylindrical button guides (11).
Figure 13:
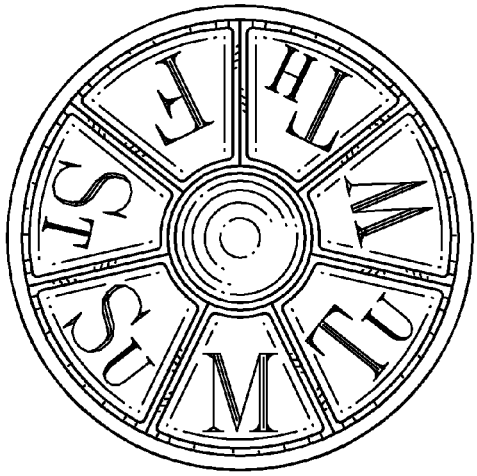
FIG. 13 is a top view of the seven button embodiment having a center reset button. In this example, abbreviations for the days of the week are found on the top surfaces of the buttons.
Figure 14:
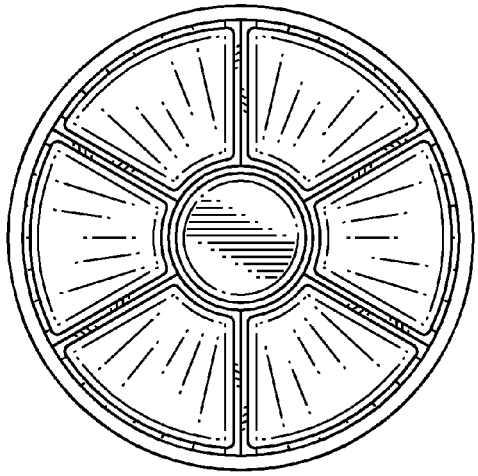
FIG. 14 is a top view of a six button embodiment having a center reset button. Such a reminder cap could be utilized when the user is required to take pills every four hours.
Figure 15:
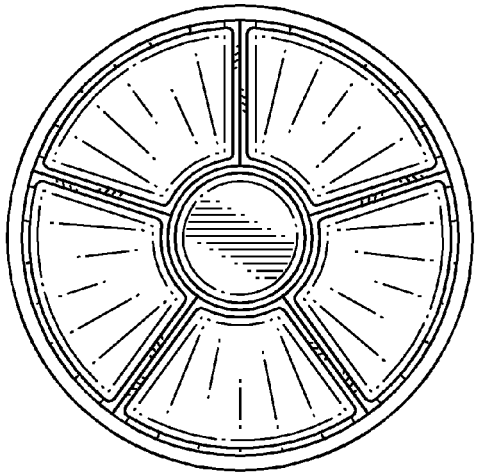
FIG. 15 is a top view of a five button embodiment having a center reset button. Such a reminder could be utilized when the user is required to take pills only five times per day or per week.
Figure 16:
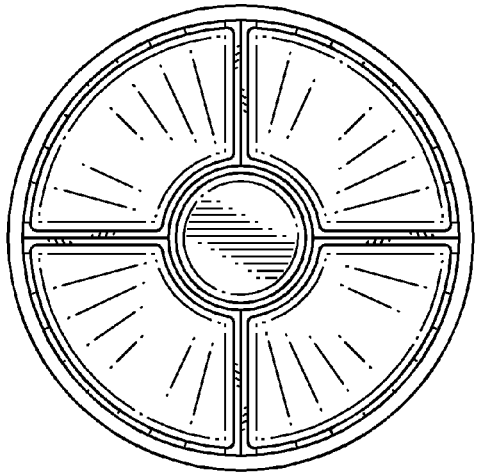
FIG. 16 is a top view of a four button embodiment having a center reset button. Such a reminder could be utilized when the user is required to take pills every six hours.
Figure 17:
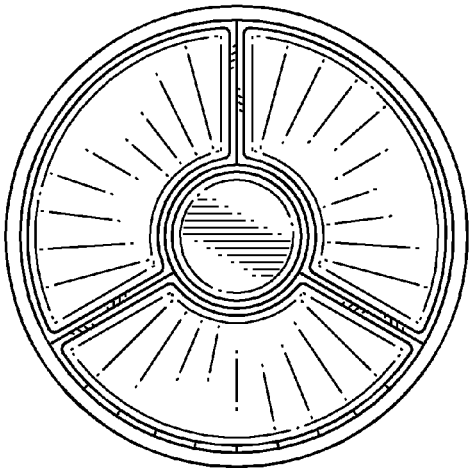
FIG. 17 is a top view of a three button embodiment having a center reset button. Such a reminder could be utilized when the user is required to take pills every eight hours.
Figure 18:
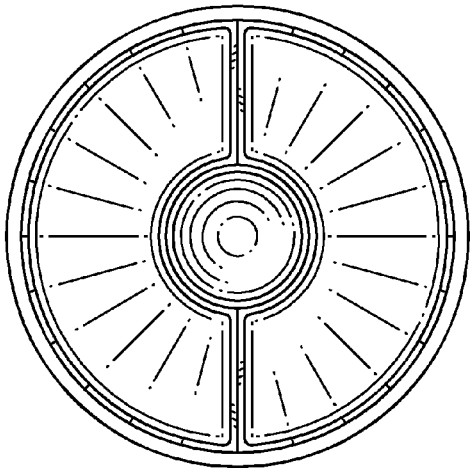
FIG. 18 is a top view of a two button embodiment having a center reset button. Such a reminder could be utilized when the user is required to take pills every twelve hours.
Figure 19:
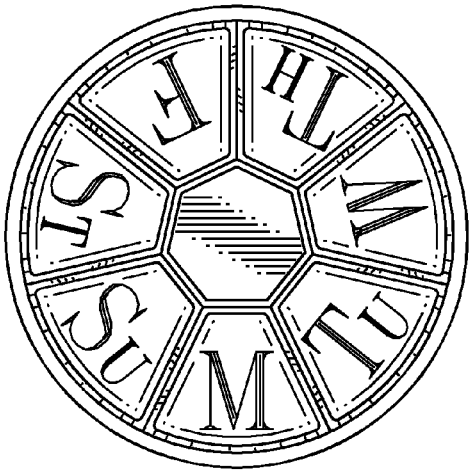
FIG. 19 is a top view of an alternative ornamental design of the seven button embodiment having a center reset button. In this embodiment, the "inner radius" is a flat surface and the center reset button is a heptagon. In this example, abbreviations for the days of the week are found on the top surfaces of the buttons.
Figure 20:
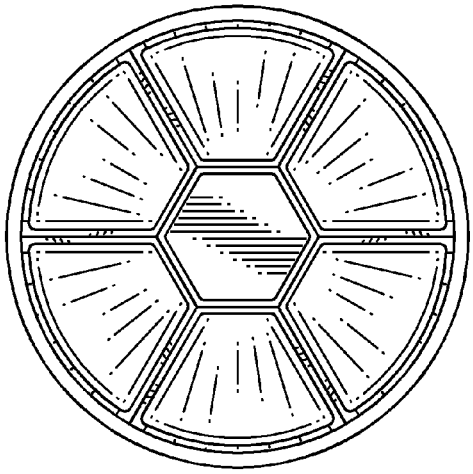
FIG. 20 is a top view of an alternative ornamental design of the six button embodiment having a center reset button. In this embodiment, the "inner radius" is a flat surface and the center reset button is a hexagon.
Figure 21:
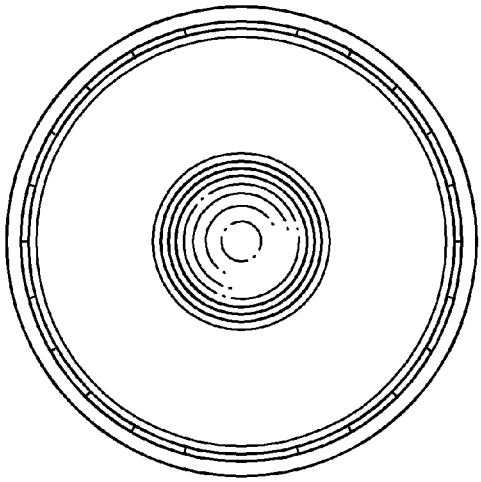
FIG. 21 is a top view of an alternative ornamental design of the one button embodiment having a center reset button.
Figure 22:
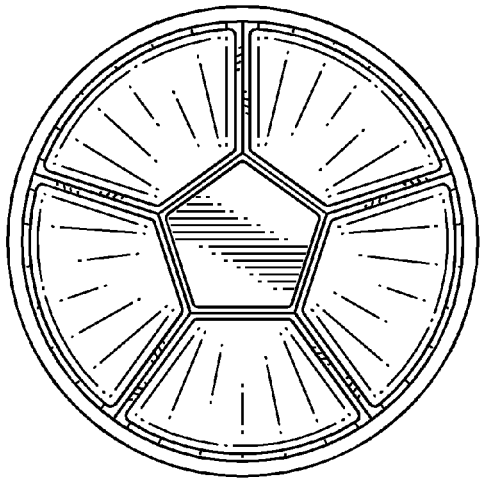
FIG. 22 is a top view of an alternative ornamental design of the five button embodiment having a center reset button. In this embodiment, the "inner radius" is a flat surface and the center reset button is a pentagon.
Figure 23:
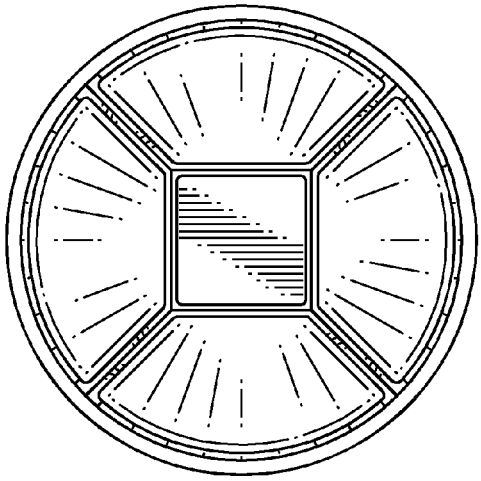
FIG. 23 is a top view of an alternative ornamental design of the four button embodiment having a center reset button. In this embodiment, the "inner radius" is a flat surface and the center reset button is a square.
Figure 24:
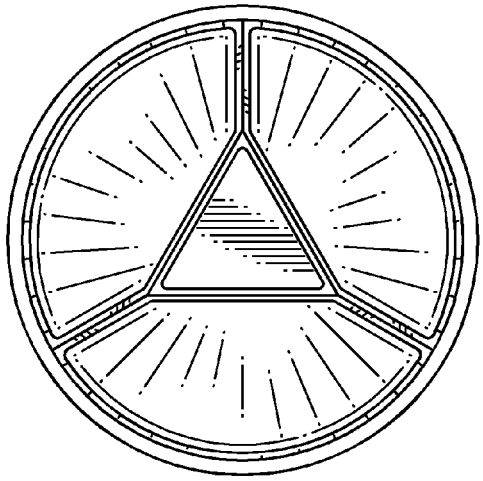
FIG. 24 is a top view of an alternative ornamental design of the three button embodiment having a center reset button. In this embodiment, the "inner radius" is a flat surface and the center reset button is an equilateral triangle.

A comparison of FIGS. 4, 9 and 11 demonstrates the flexibility of the invention's design. FIG. 4 is illustrative of the design utilizing dual wedges (6) as the button guides. This dual wedge design produces a very robust intake reminder cap as each vertical surface of the button is supported by a robust structure. That is, the buttons (3) are rigidly held in their respective space by not only the main body containment lip (5C) at the outer radius of the main body (5) and the center reset button (4), but also by two wedge shaped guide rods (6) running along the radii of the button. The strength of this design may make it the preferred design in situations where a more robust design is desired—perhaps on children's vitamin bottle caps.

FIG. 9 depicts a design wherein the dual radial wedges have been replaced by a single interior cylindrical post (11). This design is very flexible. One could replace the plastic outer radius plane (3A) and outer radius plane ramp (5D) combinations, i.e., the "outer springs," with a simple coil spring (10) that was either wrapped around or lodged inside the button containment cylinder (3F). See, FIG. 10. This design would be less dependent upon the type of plastic used to form the buttons, however, the use of coil springs would increase the cost of the device as well increase the assembly complexity. Additionally, as this device utilizes only one cylindrical button guide (11), it is less robust than the design shown in FIG. 4.

Finally, FIG. 11 presents a "dual spring" design. Each button has two sets of outer radius plane/outer radius plane ramp combinations. However, although the device has greater spring power than each of the designs described above, it is not as robust as the dual wedge design depicted in FIG. 2, as it has only a single cylindrical button guide (11).

Method of Use:

The method of use is first decided by the pill manufacturer or provider. Once a dosage is decided, an appropriate reminder cap would be installed on the pill bottle. For example, a vitamin company may call for one tablet to be taken daily. A reminder cap, such as the one depicted in FIG. 13, might be chosen. Thereafter, the user would utilize the methods graphically depicted in FIGS. 6 through 8 to track his or her pill consumption.

First, the user would remove the cap and dispense a pill. Once the user consumed the pill, he or she would put pressure on the upper surface of the reminder button (3B) bearing the appropriately labeled day of the week. As force was applied to the upper surface of the button (3B), the outer radius plane (3A) would begin traveling downward and inward along the outer radius plane ramp (5D) as it compresses and the retainer latch (3E) on the bottom of the inner radius plane (3D) would begin to move outward and begin to snap over the central locking lip (7). As the retainer latch (3E) slides over the central locking lip (7), it slightly compresses the inner radius plane (3D). See FIG. 6.

As increased force is applied to the top surface of the button (3B), the outer radius plane (3A) would continue traveling downward and inward along the outer radius plane ramp (5D). When sufficient force is applied to the top surface of the button (3B), the retainer latch (3E) on the bottom of the inner radius plane (3D) would snap over the central locking lip (7). As the retainer latch (3E) slides completely over the central locking lip (7), the stored force caused by the compression of the inner radius plane (3D) would cause the retainer latch (3E) to snap closed under the central locking lip (7), locking the button in the down position. See, FIG. 7.

Finally, once a week's worth of pills was consumed, the user must reset the reminder. To do so, the user applies pressure to the center reset button (4). The curved lower surface (4C) of the center reset button (4) contacts the outwardly curved surface of the inner radius plane (3D). When the curved lower surface (4C) of the center reset button (4) sufficiently compresses the inner radius plane (3D), the retainer latch (3E) will unlatch. The force stored in the device's outer radius planes (3B) will cause all the buttons (3) and, the center reset button (4), to rise to their fully extended positions. (Note: If the combined force stored by the device's outer radius planes is insufficient to raise the center reset button (4), a reset spring (10) may be installed to raise the reset button. See FIG. 5)

I claim:

1. A pill intake reminder and container cap device comprising:

a main body comprising two sections, an upper section and a threaded lower section; least one reminder button; and a center reset button; said upper section housing said at least one reminder button and said center reset button;

said at least one reminder button further comprising:

a top and a bottom, an outer radius plane, an inner radius plane, outer bottom tabs and an inner radius plane retainer latch; said center reset button further comprising: an upper surface, a center reset button post and a curved lower surface; said upper and lower sections each having tops and bottoms spatially arranged such that said upper section and threaded lower section are connected such that the top of said threaded lower section is the bottom of said upper section; said main body upper section further comprising: a main body containment lip, at least one ramp, a centrally located reset button containment cylinder and circumferential reminder and center reset button guides; said main body containment lip being located upon and throughout the entire length of an upper most edge of the upper section of the main body and protruding inwardly towards a center of the main body; said at least one ramp being positioned equidistantly and radially about the bottom of the upper section of the main body; said reminder button guides being positioned so as to locate the at least one reminder button such that said outer radius plane of the at least one reminder button is located above the at least one ramp, so that said outer radius plane of said reminder button is compressed when said at least one reminder button is depressed; the at least one reminder buttons' outer bottom tabs are located underneath the main body containment lip; and the inner radius plane of the at least one reminder button abuts the center reset button; said at least one reminder button being located equidistantly and radially around said central reset button; said at least one reminder button being held in place via said button guides, and said button inner radius plane and said center reset button, and a mechanical lock between said at least one button outer bottom tabs and said main body containment lip.

2. A pill intake reminder and container cap device comprising:

a main body comprising two integral sections, an upper section and a threaded lower section, two or more reminder buttons, and a center reset button; said main body upper section further comprising: a top and a bottom, a main body containment lip, two or more outer radius plane ramps, a reset button containment cylinder, reminder and center reset button guides, and a central locking lip; said outer radius plane ramps being positioned on the bottom of the main body upper section; said reminder buttons further comprising: an outer radius plane, an upper surface, at least one outer bottom tab, an inner radius plane, and an inner radius plane retainer latch;

said center reset button further comprising: a curved lower surface and a center reset button post; said center reset button post further comprising a retaining ring;

said reminder button guides being positioned so as to locate the reminder buttons such that the outer radius plane of the reminder buttons is located above the ramps, so that said outer radius plane of said reminder button is compressed when said reminder button is depressed; the reminder buttons' outer bottom tabs being located underneath the main body containment lip; and the inner radius plane of the reminder button abuts the center reset button.

3. A pill intake reminder and container cap device comprising:

a main body comprising two sections, an upper section and a threaded lower section, a center reset button, two or more reminder buttons, and a means of storing energy when said reminder button is compressed; wherein a number N is equal to two or more; said center reset button further comprising: an upper surface, a center reset button post and a curved lower surface; said reminder buttons further comprising: a top and a bottom, an outer radius plane, an inner radius plane, outer bottom tabs and an inner radius plane retainer latch; said upper and lower sections each having tops and bottoms and arranged such that said upper section and threaded lower section are connected such that the top of said threaded lower section is the bottom of said upper section;

said main body further comprising a means to centrally locate said center reset button in said upper surface of said main body and a means to locate said reminder buttons equidistantly and radially around said center reset button and a means to contain said buttons within said within said upper section;

a means to mechanically lock said reminder buttons in said upper section;

a means to lock said reminder button in a down position when depressed, and a means to release said reminder button when said center reset button is depressed.

4. A pill intake reminder and container cap device comprising:

a main body comprising two sections, an upper section and a threaded lower section, two or more reminder buttons, two or more springs and a center reset button; wherein a number N is equal to the number of reminder buttons and springs; said reminder buttons further comprising: a top and a bottom, an outer radius plane, an inner radius plane, outer bottom tabs, an inner radius plane retainer latch, and a button guide containment cylinder; said center reset button further comprising: an upper surface, a center reset button post and a curved lower surface; said main body upper and lower sections each having tops and bottoms spatially arranged such that said upper section and threaded lower section are connected such that the top of said threaded lower section is the bottom of said upper section; said main body upper section further comprising: a main body containment lip, at least one ramp, a centrally located reset button post container, radial, equidistantly spaced, cylindrical reminder button guides, a center reset button guide, and a central locking lip; said main body containment lip being located upon and throughout the entire length of an upper most edge of the upper section of the main body and protruding inwardly towards the center of the main body; said at least one ramp being positioned equidistantly and radially about the bottom of the upper section of the main body; said reminder button guides being positioned so as to locate the reminder buttons such that the outer radius plane of the reminder buttons is located above said at least one ramp, so that said outer radius plane of said reminder button is compressed when said reminder button is depressed, the buttons' outer bottom tabs are located underneath the main body containment lip, and the inner radius plane of the reminder button abuts the center reset button; said reminder button(s) further comprising an upper surface and said springs either encircling or being contained within said button guide containment cylinder;

said reminder buttons being located equidistantly and radially around said central reset button; said reminder buttons being held in place via said button guides, and said button inner radius plane and said center reset button, and a mechanical lock between said button outer bottom tabs and said main body containment lip;

said center reset button further comprising: a curved lower surface and a center reset button post; said center reset button post further comprising a retaining ring.

5. A pill intake reminder and container cap device as described in claim 1 or 2, wherein said upper surface of said reminder button(s) contains an usage indicator, wherein said usage indicator are markings that consist of at least one of the following: AM, PM, Monday, M, Tuesday, Tu, Wednesday, W, Thursday, Th, Friday, F, Saturday, St, Sunday, Su, symbols, letters, numbers, foreign languages or their Braille equivalents or colors.

6. A pill intake reminder and container cap device as described in claim 3 wherein said upper surface of said reminder button(s) contains an usage indicator, wherein said usage indicator are markings that consist of at least one of the following: AM, PM, Monday, M, Tuesday, Tu, Wednesday, W, Thursday, Th, Friday, F, Saturday, St, Sunday, Su, symbols, letters, numbers, foreign languages or their Braille equivalents or colors.

7. A pill intake reminder and container cap device as described in claim 4 wherein said upper surface of said reminder button(s) contains an usage indicator, wherein said usage indicator are markings that consist of at least one of the following: AM, PM, Monday, M, Tuesday, Tu, Wednesday, W, Thursday, Th, Friday, F, Saturday, St, Sunday, Su, symbols, letters, numbers, foreign languages or their Braille equivalents or colors.

8. A pill intake reminder and container cap device as described in claim 1 or 2 wherein the number of reminder buttons is N and the reminder button guides is 2N, said reminder button guides are wedge shaped.

9. A pill intake reminder and container cap device as described in claim 1, 2 or claim 4 wherein the number of reminder buttons is N and the reminder button guides is N, said reminder button guides being cylindrically shaped.

10. A pill intake reminder and container cap device as described in claim 1 or 2 wherein the number of reminder buttons is N and the reminder button guides is N, said reminder button guides being cylindrically shaped.

11. A pill intake reminder and container cap device as described in claim 1, 2, or 4, further comprising a center reset button spring, said center reset button spring either encircling or being contained within said reset button post container.

12. A pill intake reminder and container cap device as described in claim 1, 2, 3 or 4, wherein said main body threaded lower section further comprises a means for child proofing the device.

13. A pill intake reminder and container cap device as described in claim 4 wherein said outer radius plane of the reminder buttons and ramps are eliminated.

14. A pill intake reminder and container cap device as described in claim 2 wherein said outer radius plane of the reminder buttons and ramps are eliminated and said upper surface of said reminder buttons contains a usage indicator wherein said usage indicator are markings that consist of at least one of the following: AM, PM, Monday, M, Tuesday, Tu, Wednesday, W, Thursday, Th, Friday, F, Saturday, St, Sunday, Su, symbols, letters, numbers, foreign languages or their Braille equivalents or colors

* * * * *